US007946562B2

(12) United States Patent
Ignatoff

(10) Patent No.: US 7,946,562 B2
(45) Date of Patent: May 24, 2011

(54) KIT FOR ASSEMBLING PORTABLE RECONFIGURABLE WORK STATIONS AND WORK SUPPORTS

(76) Inventor: Elisha Ignatoff, Bronx, NY (US)

( * ) Notice: Subject to any disclaimer, the term of this patent is extended or adjusted under 35 U.S.C. 154(b) by 86 days.

(21) Appl. No.: 12/538,319

(22) Filed: Aug. 10, 2009

(65) Prior Publication Data

US 2010/0038332 A1 Feb. 18, 2010

Related U.S. Application Data

(60) Provisional application No. 61/188,878, filed on Aug. 14, 2008.

(51) Int. Cl.
*B25B 1/02* (2006.01)

(52) U.S. Cl. ..... 269/139; 269/71; 269/901

(58) Field of Classification Search ..... 269/139.138, 269/58, 71, 289 R, 901, 909
See application file for complete search history.

(56) References Cited

U.S. PATENT DOCUMENTS

| | | | | |
|---|---|---|---|---|
| 2,636,526 | A * | 4/1953 | Madden | 144/286.1 |
| 4,155,386 | A * | 5/1979 | Alessio | 144/286.1 |
| 4,159,821 | A * | 7/1979 | Hickman | 269/139 |
| RE35,627 | E * | 10/1997 | Estrem | 144/329 |
| 5,884,681 | A * | 3/1999 | Nickles | 144/329 |
| 7,140,409 | B2 * | 11/2006 | Leberfinger et al. | 144/286.1 |
| 2010/0038332 | A1 * | 2/2010 | Ignatoff | 211/201 |

* cited by examiner

*Primary Examiner* — Lee D Wilson

(57) ABSTRACT

A kit of modular parts from which the user may assemble portable multi-configurable work stations, work support structures or structures that perform both functions alternately or concurrently; whose support does not derive from a continuous surface.

13 Claims, 18 Drawing Sheets

Fig. 9
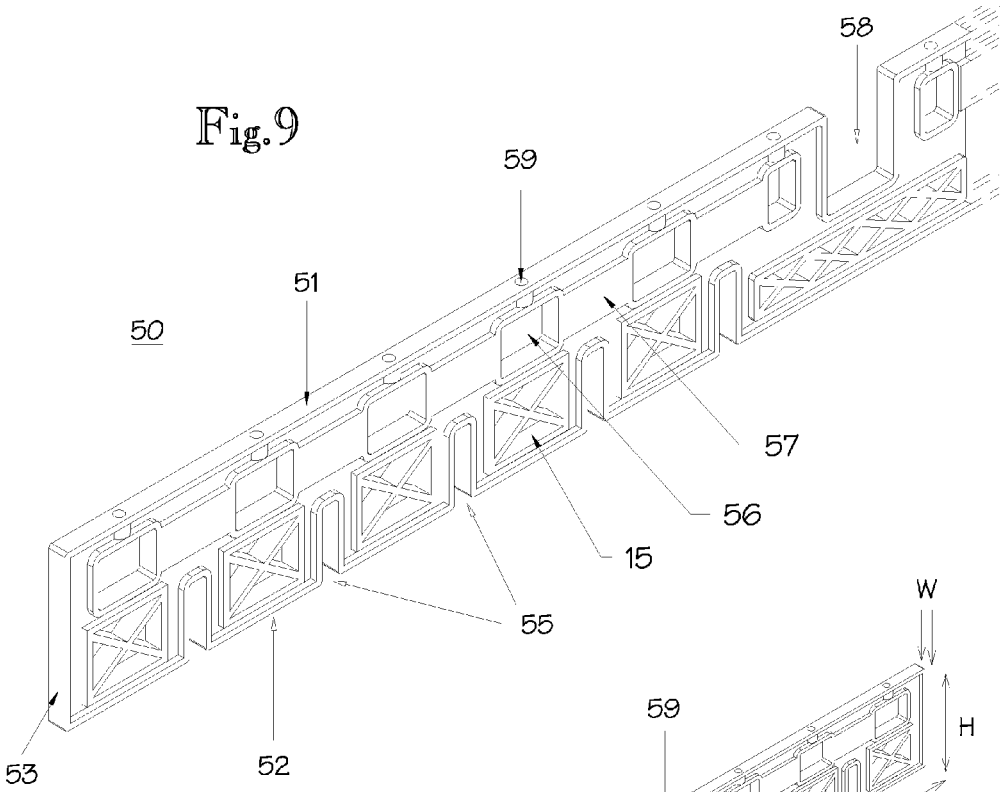
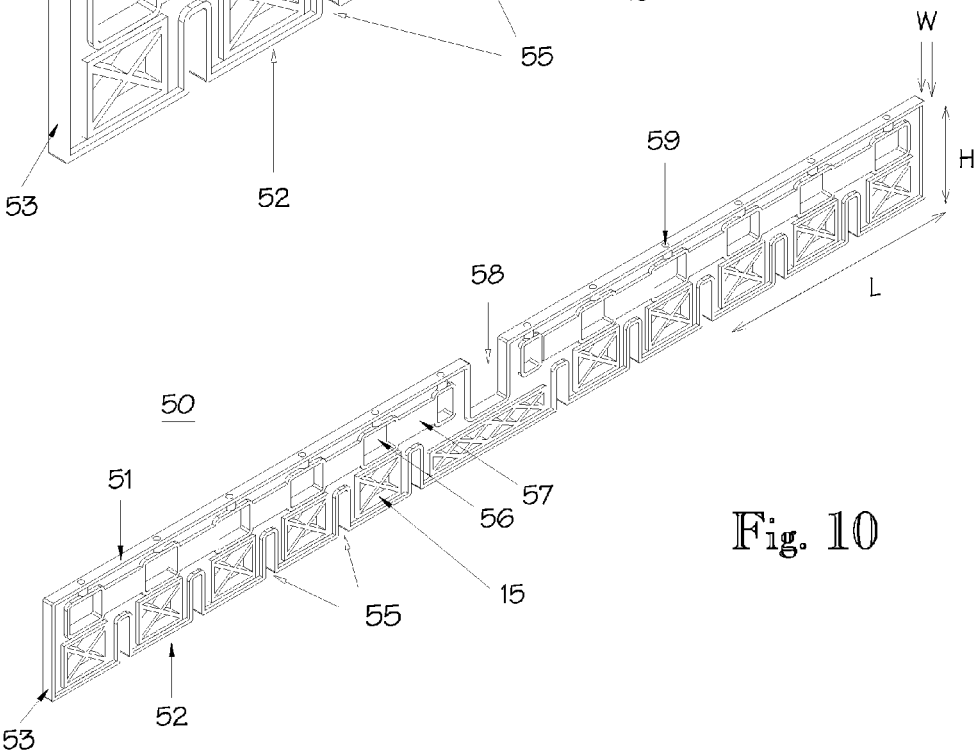
Fig. 10

KIT FOR ASSEMBLING PORTABLE RECONFIGURABLE WORK STATIONS AND WORK SUPPORTS

This application claims benefit of provisional application Ser. No. 61/188,878 filed on Aug. 14, 2008

FIELD OF THE INVENTION

The present invention relates to a kit of modular parts from which the user may assemble portable multi-configurable work stations, work support structures or structures that may perform both functions alternately or concurrently. Such a kit includes parts connected via a notch and channel connector system, a notch and ear connection system, a rail and channel connector system, or combinations thereof; that may be useful in the fields of construction, renovation, maintenance/repair/furnishing, home improvement, DIY and the like, and in temporary and re-configurable light manufacturing settings.

BACKGROUND OF THE INVENTION

In the fields of construction and renovation, there is often a need for work support structures on which construction materials or objects can be temporarily secured, at a convenient working height, while they are sawn or otherwise worked with hand-held tools. In the current art this function is most often performed with trestle type supports (e.g. saw horses.) There is also frequently a concurrent need for devices that provide support, at a convenient working height, for portable bench-type power tools, and auxiliary infeed, outfeed and sidefeed support for the same (workstations.) In the current art this function is most often performed with tool stands. Existing portable tool stands for "feed-through" type tools (such as portable table saws) frequently sacrifice optimum workpiece support to meet their requirement for portability and/or are otherwise difficult to re-configure in a manner that suits the varying needs of the user from task to task.

Existing portable tool stands for "in place" type tools (such as power miter saws) are dedicated solely to those types of tool, requiring the user to own multiple sets of stands in addition to a set of work supports for use with hand-held tools, and to dismount one tool and replace it with another.

In the fields of maintenance/repair/refinishing there is often a need for support structures whose performance does not degrade in the presence of the oils, coatings, solvents and adhesives used, which allow spent (or unused) fluids to drain through, and which provide access to all sides of the object being worked upon.

In temporary and re-configurable Light-Manufacturing settings there is a need for readily reconfigurable work support structures that can be extended indefinitely to the user's requirements or that can be deployed in independent assemblages, used in conjunction with one another, that share a common working height.

In the DIY ("do it yourself") sphere there is a need for a user to be able to do some or all of the above on an irregular and intermittent basis; placing a premium on a single reconfigurable structure to answer all occasions and all needs of a user.

In the current art work support structures are of three basic types, one based on a collapsible trestle (e.g., folding sawhorses), another based on a collapsible column and the third based on the table (e.g., traditional "woodworker's bench").

The use of all collapsible trestle and collapsible column support devices carry a common set of risks; each with numerous undesirable consequences.

The most frequent and consequential of these is the risk of cutting through (or into) the trestle beam (or column top) while performing a cut or other operation. Work supported on a single pair of trestles carries an additional risk that is also experienced when a trestle beam is completely severed. As the cut progresses, the forces acting on the workpiece (and/or the trestle beam) will either begin to bring the emerging parts into compression against one another, or cause them to fall away from one another.

In the first instance the cutting edge(s) can become bound in the cut; with undesirable consequences. Additionally, the movement of the parts before the completion of the cut will introduce a bevel into the plane of the cut which degrades the quality of the joint that can be produced between that plane and another part. In the second instance the workpiece may tear apart before the cut is completed.

In any event, when the cut is completed (or when the workpiece separates spontaneously) the two resulting parts are suddenly no longer supported on three or more points, but each, only on two or fewer. It is about these new-formed axes that both parts will wish to rotate, or in the absence of any support, will commence to fall. This may pose a safety hazard to the operator and risks damaging either or both the keeper and the offcut.

In the current art the use of two or more pairs of trestles (or even of a single pair) in close proximity to one another is often impossible, owing to the interference of their legs with each other.

In the current art work support structures based on the table, by virtue of it having a top, may prevent access to the underside of a workpiece. Moreover, since its support is provided by the table top surface, it is only off of that surface that the portion of a tool's cutting edges that projects below the cut does not cut into or through that table top.

A need therefore exists for work support structures and workstations that are lightweight, provide stability and securement for workpieces and/or portable power tools, that neutralize the risks inherent in the use of the devices of the current art, and that may be readily re-configured to optimize one or more functions of tool and/or workpiece support.

All expressions of the prior art coalesce around creating a single object (which then may, or may not, be used in groups); or of a single use device. In addition to the improvements in safety and utility, and the combination of features not heretofore available together; it is the ready reconfigurability of this kit of parts, to accommodate a wide variety of requirements, which constitutes a significant novelty of this invention.

SUMMARY OF THE INVENTION

A kit of modular parts from which a user may assemble portable, reconfigurable multi-use workpiece support and/or workstation assemblages utilizing a notch and channel, a notch and ear, a channel and rail connecting system or combinations thereof.

BRIEF DESCRIPTION OF THE DRAWINGS

FIGS. 1-18 are various views of the components of a work station or workpiece support structure in accordance with embodiments of the present invention. Specifically:

FIG. 1 is perspective view of a short cross beam;

FIG. 2 is perspective view of a long cross beam;

FIG. 3 is perspective view of a leg with an integral receiver section;

FIG. 4 is a side view of the leg of FIG. 3;

FIG. 5 is a perspective view of a receiver section of the leg of FIGS. 3-4;

FIG. 6 is perspective view of an upper leg with a hinged receiver section;

FIG. 7 is perspective view of a leg connected to a cross member;

FIG. 8 is a section view of the hinged connection of the leg of FIG. 6;

FIG. 9 is a truncated perspective view of a rail;

FIG. 10 is a perspective view of a rail;

FIG. 11 is a truncated perspective view of a rail having ear ends;

FIG. 12 is a perspective view of a rail having ear ends;

FIG. 13-14 are perspective views of a trolley;

FIG. 15 is a perspective view of a tool mounting plate

FIG. 16 is a perspective view of a tray.

FIG. 17 is an exploded perspective view showing the legs, rails and cross members before connection;

FIG. 18 is a perspective view of legs, rails and cross members after connection.

FIG. 19 is a perspective view of a sub-assembly consisting of three cross beams and four rails.

FIG. 20 is a perspective view of a sub-assembly consisting of one long cross beam and two legs.

FIGS. 21 and 22 are perspective views of sub-assemblies consisting of one short cross beam and two legs.

Figure 1:
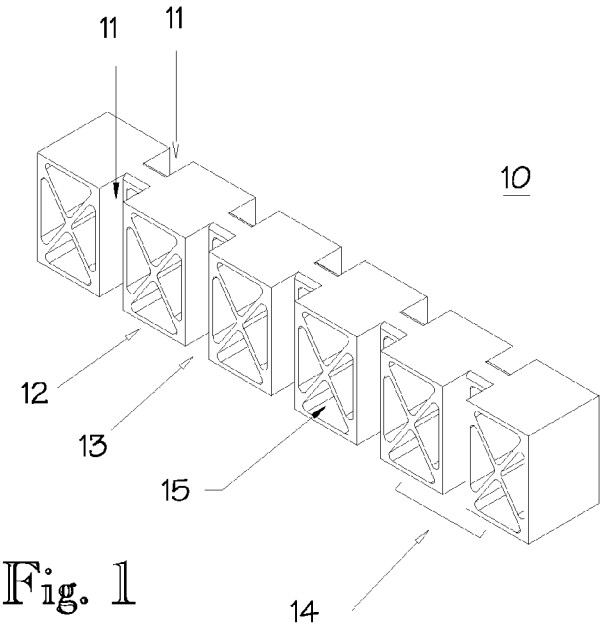

A figure suitable for the Abstract Page is provided separately.

It should be noted that all of the Figures in the present disclosure depict possible assemblages according to various embodiments of the present invention, and the invention is not limited to any of the embodiments depicted in the Figures. Additionally, various embodiments of the invention are fully disclosed in the present disclosure even though they may not be depicted in the Figures.

DETAILED DESCRIPTION OF THE PREFERRED EMBODIMENTS

In various embodiments, the present invention is directed to a kit of parts that the user may purchase as a single system, or as individual parts; and assemble into re-configurable workpiece and/or tool support structures, as well as structures which combine characteristics of both, that are modifiable and expandable to suit his or her specific needs. The support structures of the present invention are lightweight, stable and cost effective.

In various embodiments the kit may consist of cross beams 10, legs 30 and rails 50. In various embodiments the kit may include accessory items such as, but not limited to: trolleys 60, tool mounting plates 70, and/or trays 80.

Figure 2:
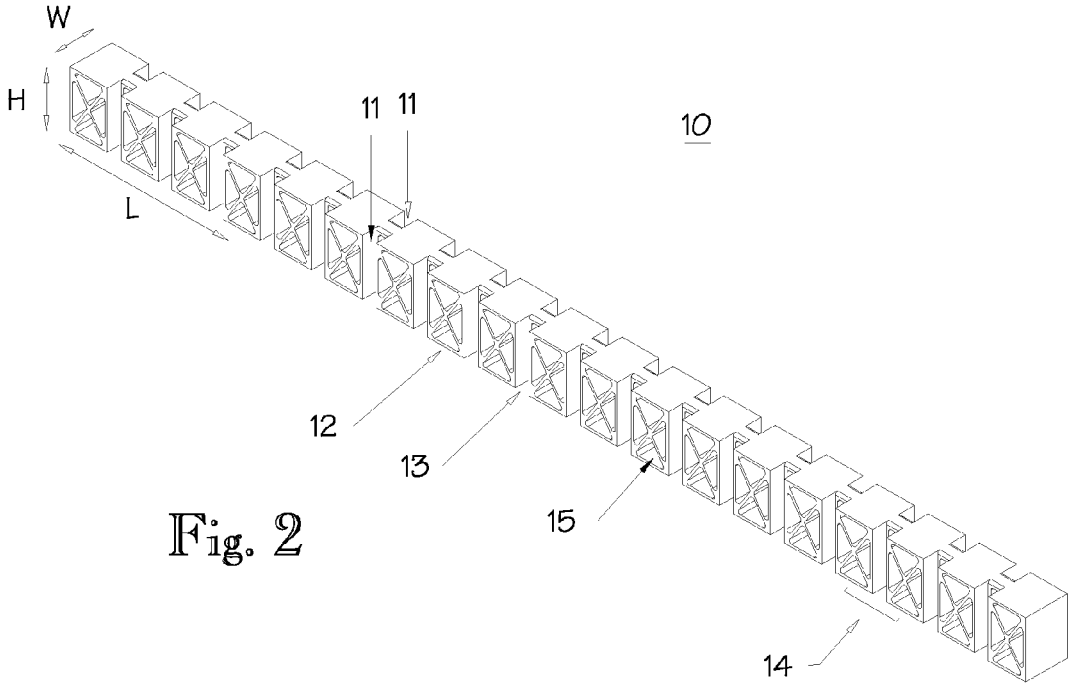

In various embodiments (as shown in FIGS. 1 & 2) the cross beams 10 are elongated members having length (L) width (W) and height (H) which have at least 5 or more connection locations 14 where they may engage either a leg 30 or a rail 50 from the same kit. In certain embodiments separate connection locations for rails 50 and legs 30 may be present.

In various embodiments of the invention the length (L) of a cross beam 10 of a given kit is between about 12 inches to about 48 inches; although longer or shorter lengths are contemplated.

In various embodiments of the invention the width (W) of a cross beam 10 of a given kit is between about 2 inches to about 4 inches. In various embodiments of the invention the height (H) of a cross beam 10 of a given kit is about 3 to about 6 inches; being about half the height (H) of a rail 50 of that kit.

In various embodiments the connection location is formed by the faces of two symmetrically opposing channels 11 in the lateral faces 12 of the cross beam 10. The space between opposing channels (on the transverse axis of the cross beam 10) comprises a connecting segment 13 and is dimensioned (along with the faces of the channels 11) to mate slideably with the notches 55 on the bottom aspect 52 of a rail 50 and/or the notches 38 of the receiver section 32 of a leg 30. These channels 11 may or may not be perpendicular to the longitudinal axis of the cross beam 10, and the connecting segment may or may not extend through both the upper and lower faces of the cross beam 10 or protrude beyond either or both. In certain embodiments these channels are square or rectangular in section, but other shapes (circular, hexagonal, octagonal, T-shaped etc.) are contemplated.

In various embodiments, when engaged with a leg 30, all or a portion of the lateral faces 12 of the cross beam 10 adjacent to the connecting segment 13 also form a part of the connection location 14.

In various embodiments the cross beams 10 may be made like a girder with an open web structure 15 between the faces which mate with other parts. In various embodiments the cross beam 10 may be an enclosed hollow form that may or may not be filled. In certain embodiments the cross beams are square or rectangular in section, but other shapes (circular, hexagonal, octagonal, T-shaped etc.) are contemplated.

In various embodiments, the legs 30 of a kit may be comprised of a receiver section 32 and a stand section 31.

Figure 5:
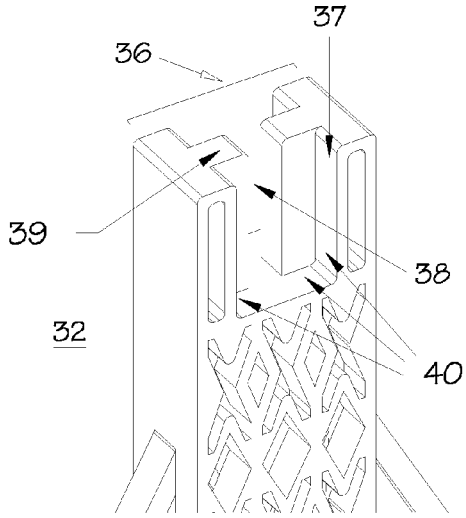
Figure 7:
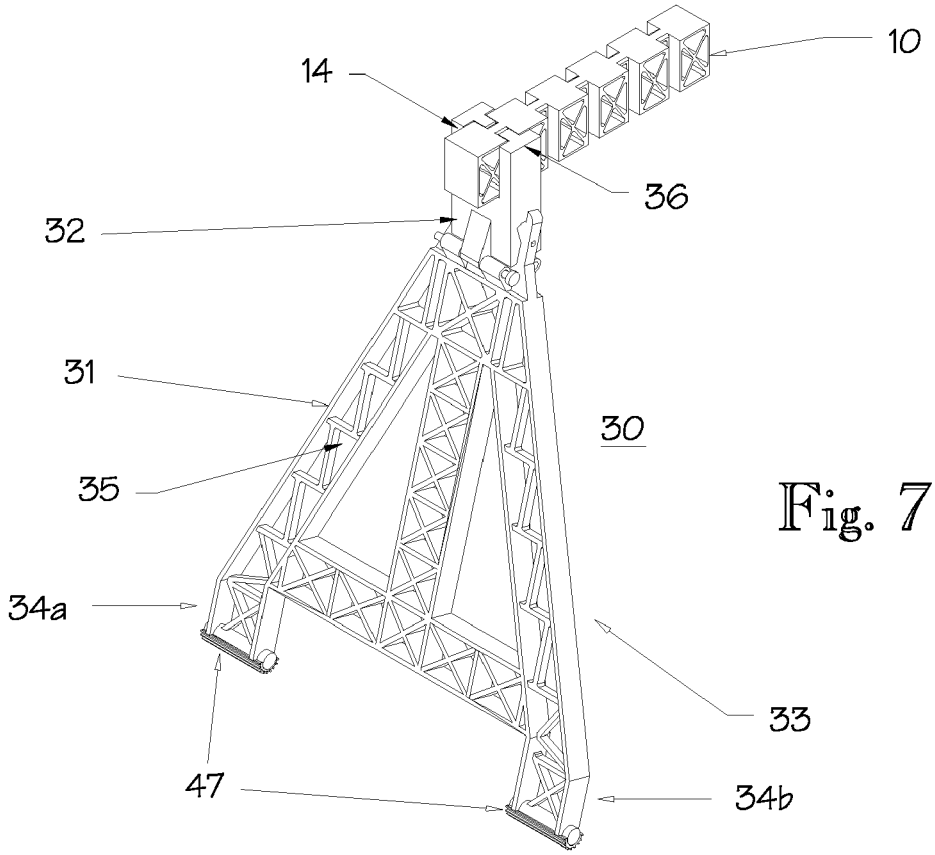

As shown in FIG. 5, in various embodiments the receiver section 32 includes a notch/channel connecter 36. The connector 36 has a recess 37 capable of receiving the cross beam 10. The recess 37 includes a center groove 38 with two side members 39. As shown in FIG. 7, in use, the cross member 10 slides into the recess 37 of the receiver section 32 with the lateral faces 12 of the cross beam 10 being supported by the faces 40 of the recess 37 and the connecting segment 13 sliding into the center groove 38.

The stand section 31 has a triangular portion 33 which is connected at the bottom side of the triangle to two feet 34*a* and 34*b* designed to optimally transfer the total load to the ground, irrespective of the orientation of the stand section to the receiver section. In various embodiments the terminal aspect of these feet will be tubular (as shown in FIG. 7), however, a free pivoting triangular bracket terminus for these feet is also contemplated. As shown in FIG. 7, the feet may be covered with a pad 47 of ribbed non-slip material. In embodiments that utilize a free pivoting triangular bracket terminus for the feet the bottom aspect of the bracket may or may not be covered with a pad of non-slip material In various embodiments, the triangular section 33 may be a light-weight design such as an open web design 35 for strength. Closed hollow or filled hollow design structures and other shapes besides triangles may be used.

Figure 3:
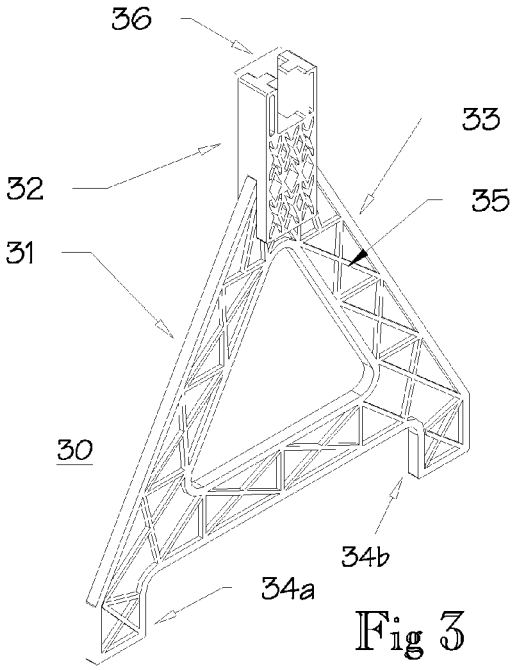
Figure 4:
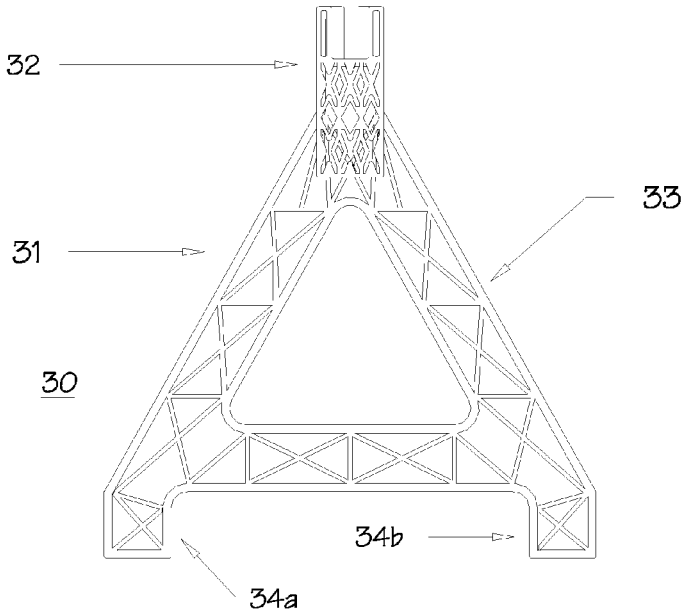
Figure 6:
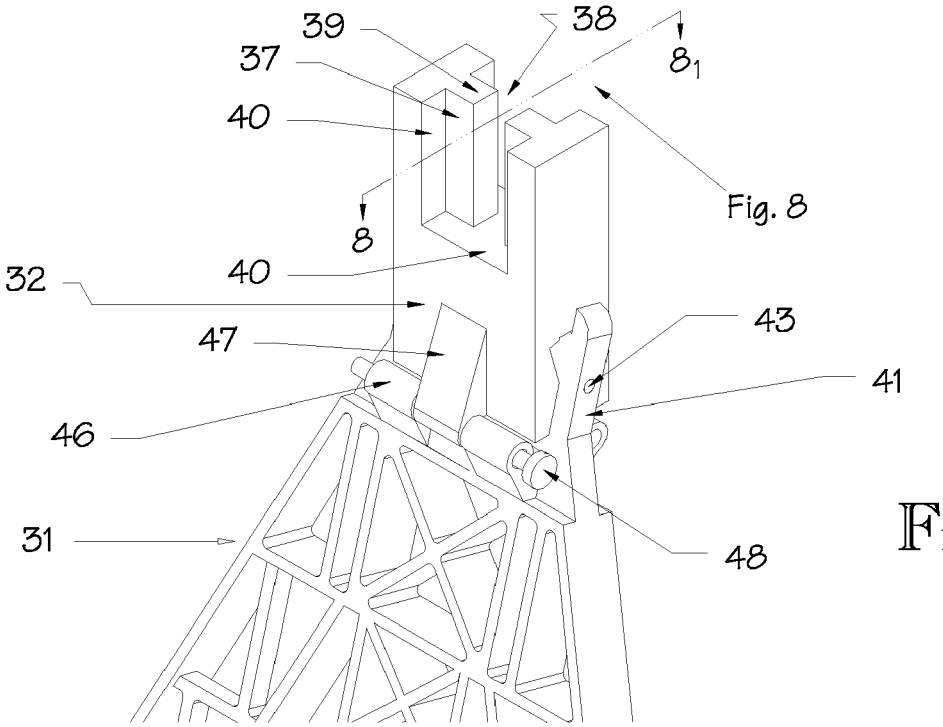
Figure 8:
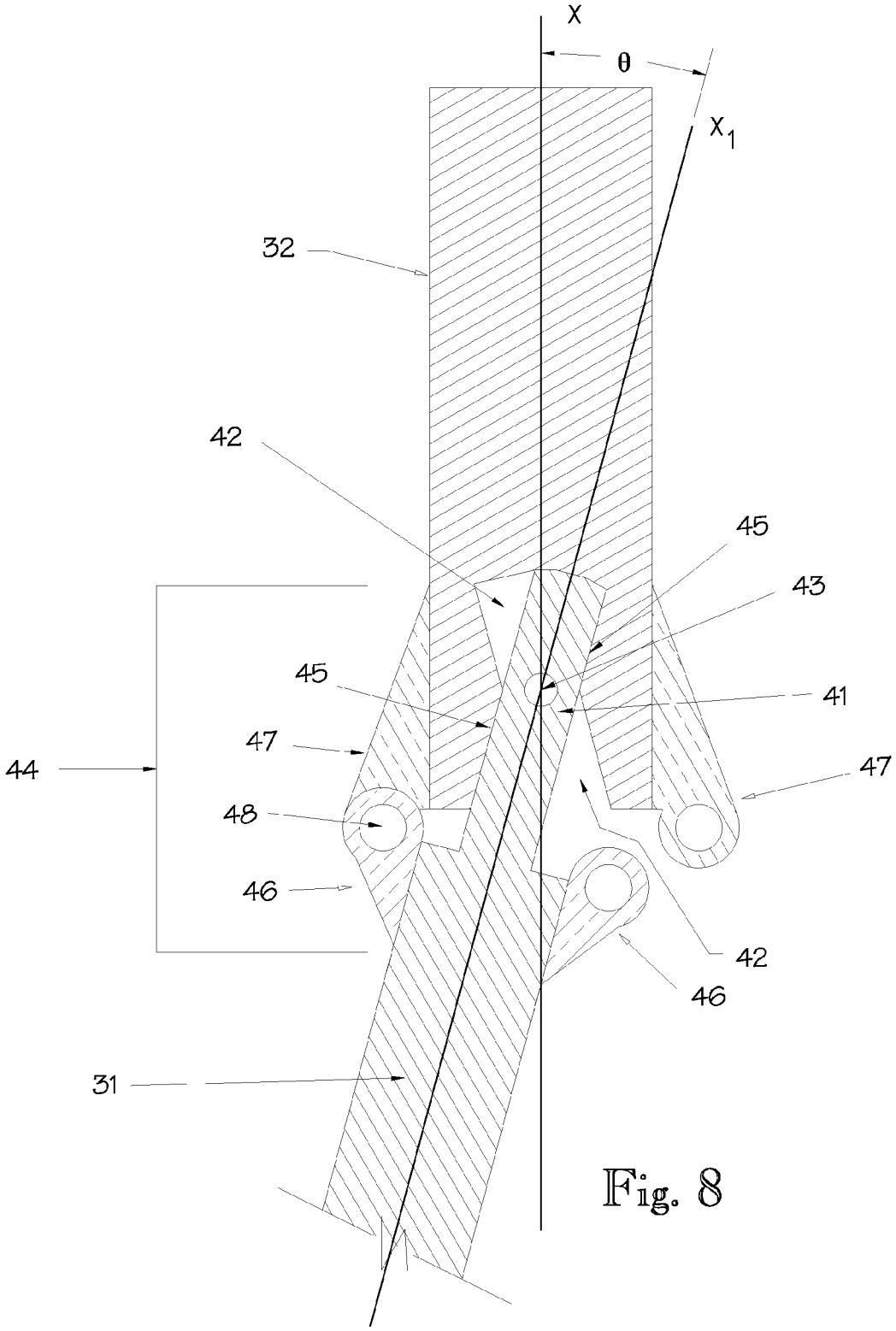
Figure 11:
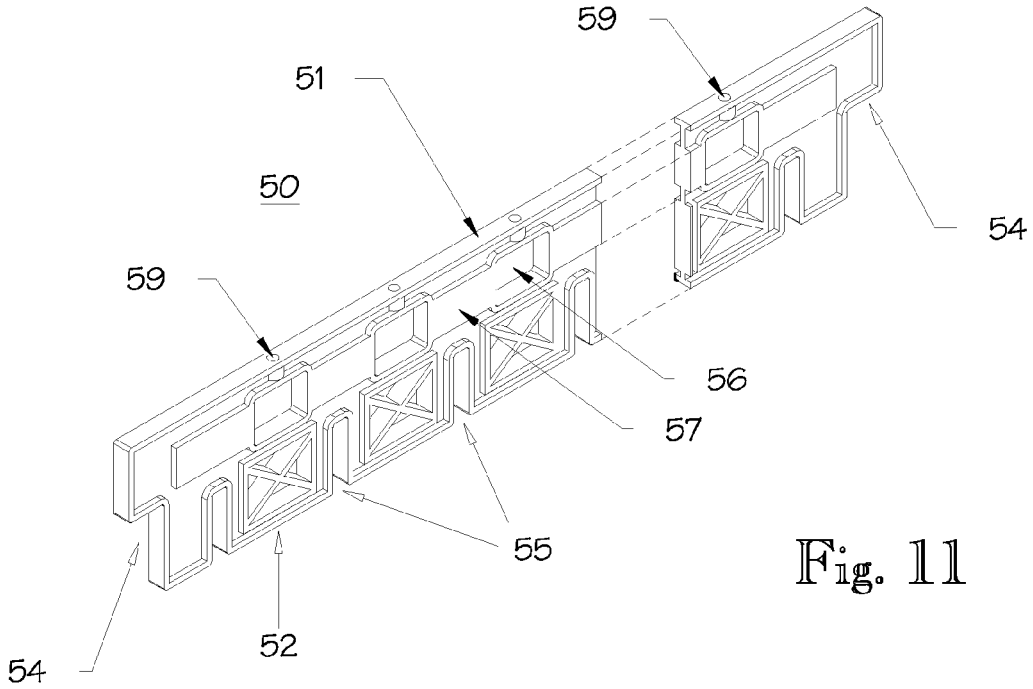
Figure 12:
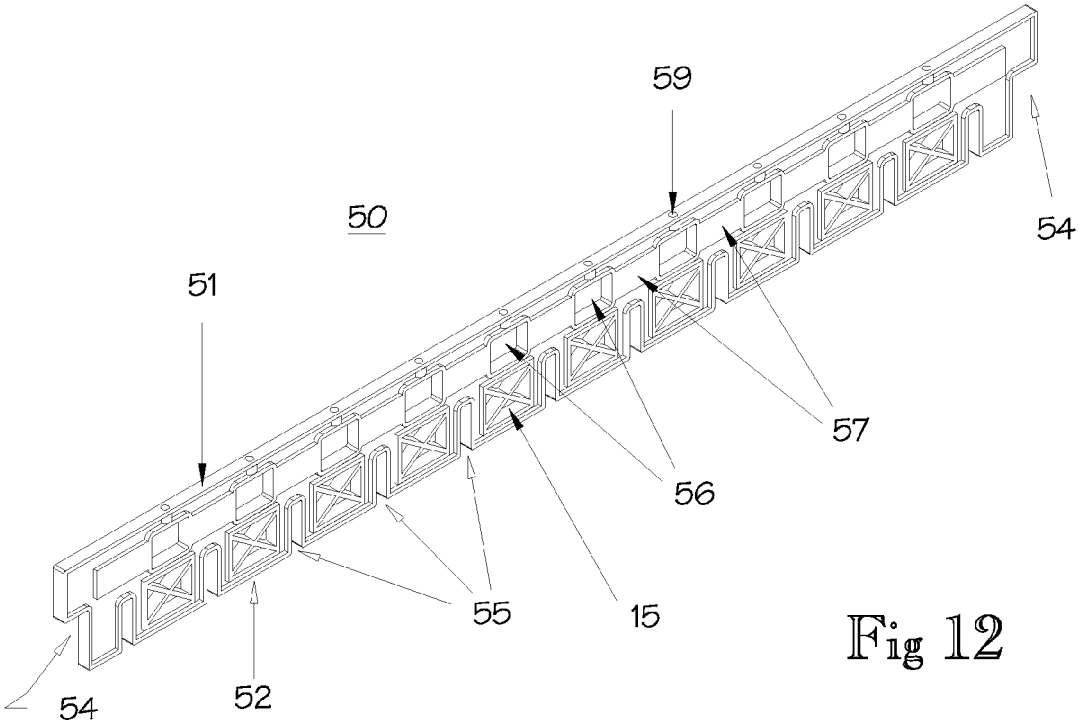

As shown in FIGS. 3, 4 and 5, in various embodiments the receiver section 32 is integral to and aligned with the stand section 31. In contrast (as shown in FIGS. 6 and 7) in other embodiments the stand section 31 and receiver section 32 are hinged together. As shown in FIGS. 6 and 8, in the hinged design depicted therein, a portion 41 of the stand section 31 projects into a cavity 42 in the receiver section 32, and the two parts pivot about a fixed pin 43. The projection of the stand section 31 extends beyond this pivot point further into the cavity. The cavity 42 in the receiver section 32 is shaped so that, as the two parts pivot against one another, the projection 41 of the stand section 31 comes to bear against the interior faces 45 of the cavity 42 limiting the travel of the stand section 31 relative to the receiver section 32 to the angle θ to either side of the center line X of the receiver section 32. The range of the angle θ is between about 10 degrees and about 22½ degrees.

In various embodiments a latch or other fastening is provided to secure the stand section 31 to the receiver section 32 at either extreme of its travel with the bearing faces held in compression against one another. In certain embodiments (as shown in FIGS. 6 and 8) this fastening is made via a "loose pin" connection 44 composed of two pin knuckles 46 on the stand section 31 and a single pin knuckle 47 on the receiver section 32 (on both sides of the two sections) whose holes align when the stand section 31 and the receiver section 32 are at either extreme of their relative travel. The fastening is made by inserting a "loose pin" 48 into the aligned holes of the three knuckles. Other types of fastening are contemplated including, but not limited to "bail" or "hook" or "ball" type latches.

In various embodiments the receiver and stand sections may be integral and fixed at an angle in the range of the angle θ above.

FIGS. 9-12 show a rail 50 according to certain embodiments of the invention. In various embodiments the rails 50 of a kit are elongated members having length (L) width (W) and height (H) which have at least two or more notches 55 on their lower aspects 52 that are dimensioned to slideably mate with the channels 11 of a cross beam 10 of the same kit. In the various embodiments, the notches 55 on the lower aspect 52 of the rails 50, where they mate with the channels 11 of a cross beam 10, are dimensioned in such a manner that the top aspect 51 of the rails 50 protrude a uniform distance above the cross beam 10 when fully engaged with that beam. It is the multiplicity of such rails 50 that creates the "working surface" of a workstation or work support assemblage according to the present invention, while providing an unobstructed tool/cut path between rails 10.

In various embodiments of the invention the length (L) of a rail 50 of a given kit is about 6 feet; although longer or shorter lengths are contemplated.

In various embodiments of the invention, in order to facilitate users' creation of "custom" rails for their own use, the width (W) of a rail 50 of a given kit is between about ½ to 1½ inches and may conform to one of the standard thicknesses of commercially available lumber and other materials.

In various embodiments of the invention the height (H) of a rail 50 of a given kit is about 6 to 12 inches; being about twice the height (H) of a cross beam 10 of that kit. In certain embodiments, where additional clearance between the "working surface" (created by the multiplicity of rails 50 and the cross beams 10) is desired; the height (H) of a rail 50 of a given kit may be more than twice the height (H) of a cross beam 10.

Figure 17:
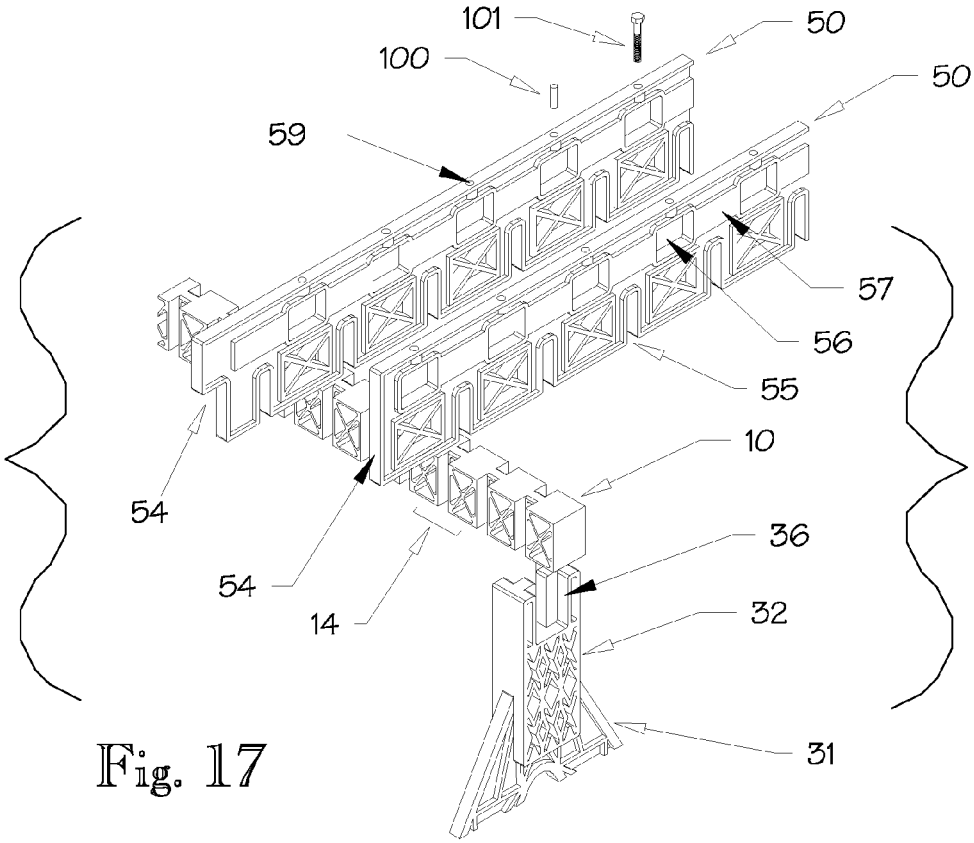
Figure 18:
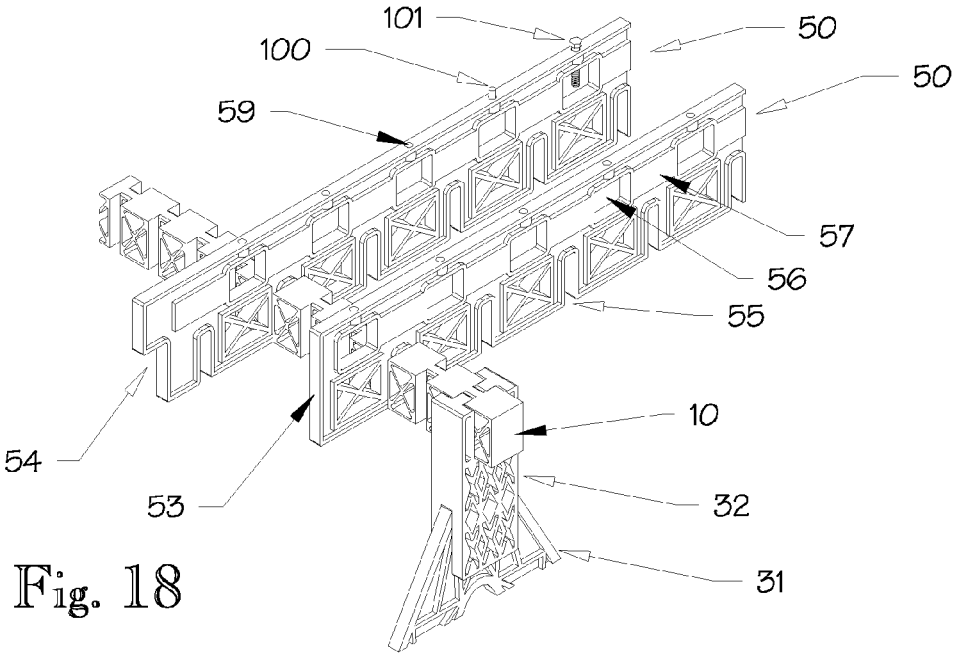
Figure 31:
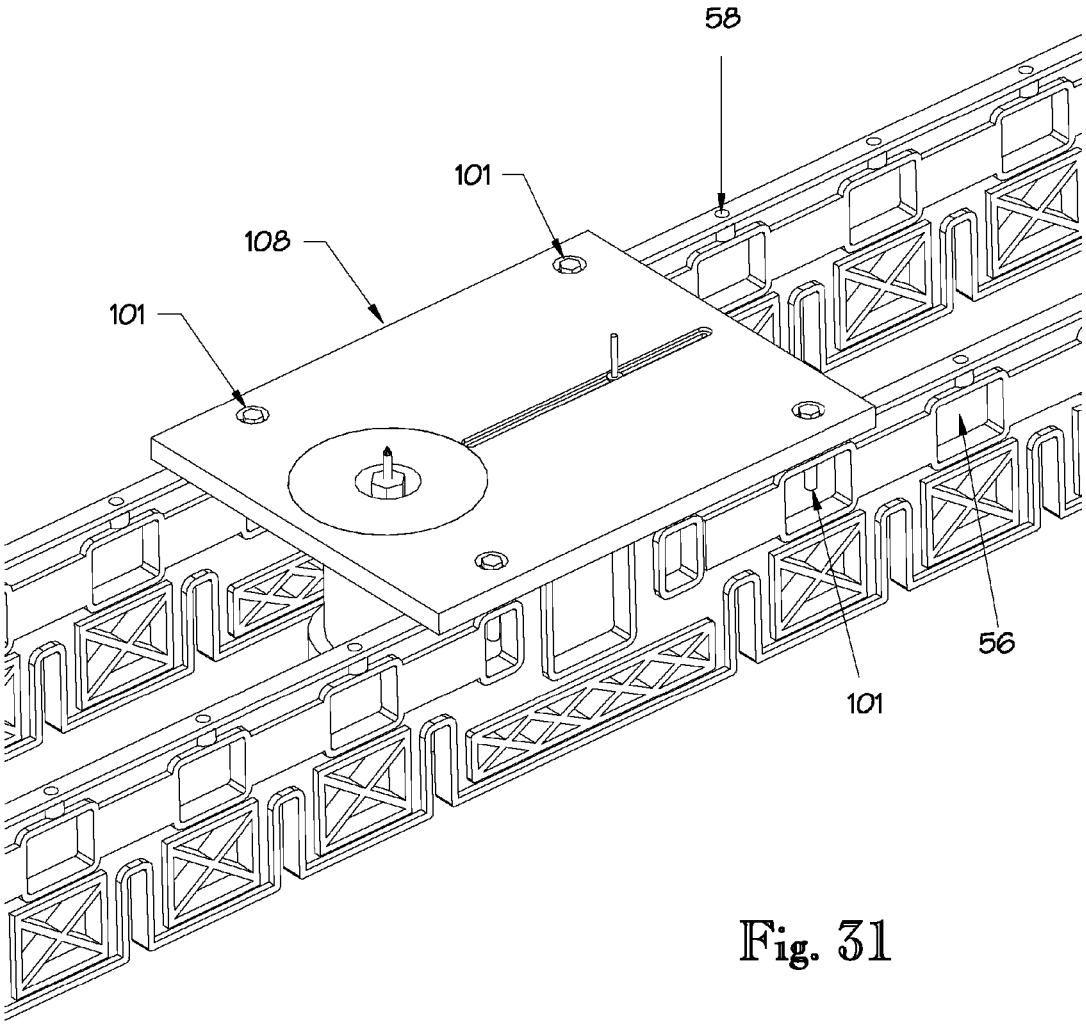
FIG. 31 shows how a jig or fixture may be mounted to a rail utilizing a threaded bolt inserted into a pin socket in certain embodiments of the invention.

In various embodiments, the rails 50 may come equipped with any, all or any combination of the following: one or more cross-cut passthrough notches 58 on the upper aspect 51 of the rail 50 (to permit the passage of the cutting edges of a tool which protrude below the cut to pass through without cutting into a rail 50), one or more clamp apertures 56 in the lateral aspect of the rail 50 to facilitate the clamping of objects to the top 51 and end 53 aspects of the rail 50, one or more clamp pad locations 57 on the lateral aspects of the rail 50 to facilitate the clamping of objects to those aspects of the rail 50, one or more ear ends 54 to pinion tool mounting plates 70 against suitably spaced cross beams 10, one or more pin sockets 59 in the top aspect 51 of the rail 50 for the temporary insertion of stop pins 100 (as shown in FIGS. 17 and 18) whose function is analogous to that of the "bench dogs" associated with a traditional woodworker's bench, or threaded bolts 101 for securing user made or commercially available jigs and fixtures to a rail or rails 50 (as shown in FIG. 31.)

In various embodiments clamp apertures 56 are regularly located along the lateral aspect of the rails 50, somewhat below the top face 51 of the rail 50, and directly beneath the pin sockets 59. Their upper aspects lie in a plane parallel to the upper aspect 51 of the rail 50.

In various embodiments clamp pad locations 57 are located between the clamp apertures 56 and between the clamp apertures 56 and the ends of a rail 50, symmetrically, on both lateral aspects of the rail 50. The edges of the top 51 and bottom 52 aspects of the rail 50 and the surface of the clamp pad locations 57 lie on a single plane.

In certain embodiments certain rails 50 may be formed with an "ear end" 54 in the form of a protrusion of part of the upper portion of the end aspect of the rail 50 beyond the lower portion.

According to various embodiments of the present invention, the notches 55, on the lower aspect 52 of the rails 50, where the notches mate with the channels 11 of a cross beam 10, are dimensioned in such a manner that the top aspect 51 of the rails 50 of a kit protrude a uniform distance above the cross beam 10 when fully engaged with that beam. It is the multiplicity of such rails 50 that creates the "working surface" of a workstation or work support while providing an unobstructed tool/cut path between rails 50. In certain embodiments rails 50 that protrude a greater or lesser amount above this "working surface" may be present.

In various embodiments the rails 50 may be made like a girder with an open web structure 15 between the faces which mate with other parts. In various embodiments the rails 50 may be an enclosed hollow form that may or may not be filled. In certain embodiments the rails 50 are square or rectangular in section, but other shapes (circular, hexagonal, octagonal, T-shaped etc.) are contemplated.

Figure 13:
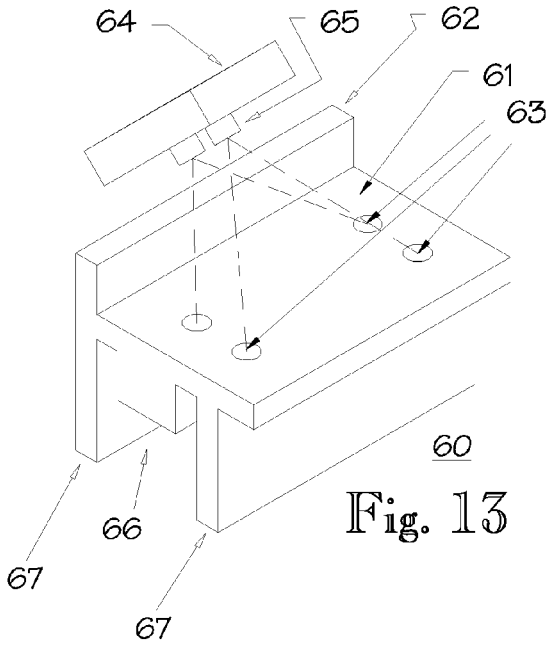
Figure 14:
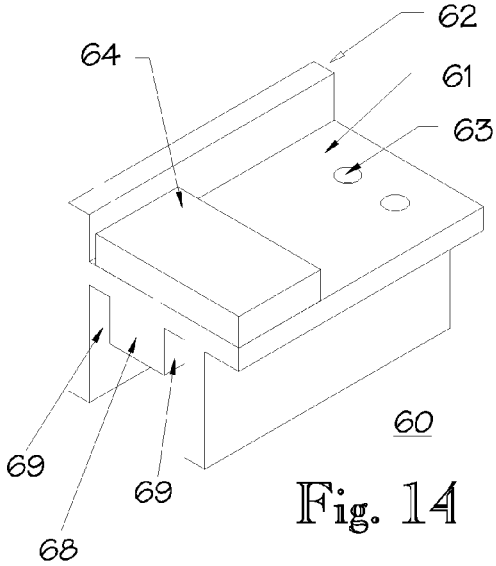

FIGS. 13 and 14 show a trolley 60 in accordance with certain embodiments of the present invention. The trolley 60 may have a plate portion 61. In various embodiments, the plate portion 61 may be about 3 inches to about 24 inches in length (L), about 3 inches to about 18 inches in width (W) and about ⅛ inch to about 3½ inches in height (H). The back edge of the plate section 61 may include an upward facing flange 62 for engaging workpieces. In certain embodiments, in the top face of the plate 61 are four apertures 63 for receiving the pins 65 of a snap-in stop 64. On the bottom of the plate 61 is a rail/channel connector 66 that is comprised of two downward facing flanges 67 which extend past the bottom aspect of the clamp apertures 56 of the rails 50 of that kit, without extending into the plane of the cross beam 10 of that kit. Set between the flanges are one or more spacer stubs 68 which do not extend into the opening of the clamp apertures 56 of the rails 50 of that kit. Together with the flanges 67 these stubs 68 define the channels 69 of the rail/channel connector 66. In certain embodiments these channels 69 are square or rectangular in section, but other shapes (circular, hexagonal, octagonal, T-shaped etc.) are contemplated. The channels 69 are dimensioned to permit a trolley 60 to ride and be temporarily secured at any point along a pair of suitably placed rails 50. Trolleys that encompass more than two rails are contemplated.

In certain embodiments, single rail trolleys 60 may be present. These differ from multi-rail trolleys 60 in the lack of a spacer stub(s) 68 and the requirement that the downward facing flanges 67 have sufficient "flex" to be held in compression against the clamp pad locations 57 of the rails 50 of that kit. Trolleys 60 that encompass more than two rails are also contemplated.

Figure 15:
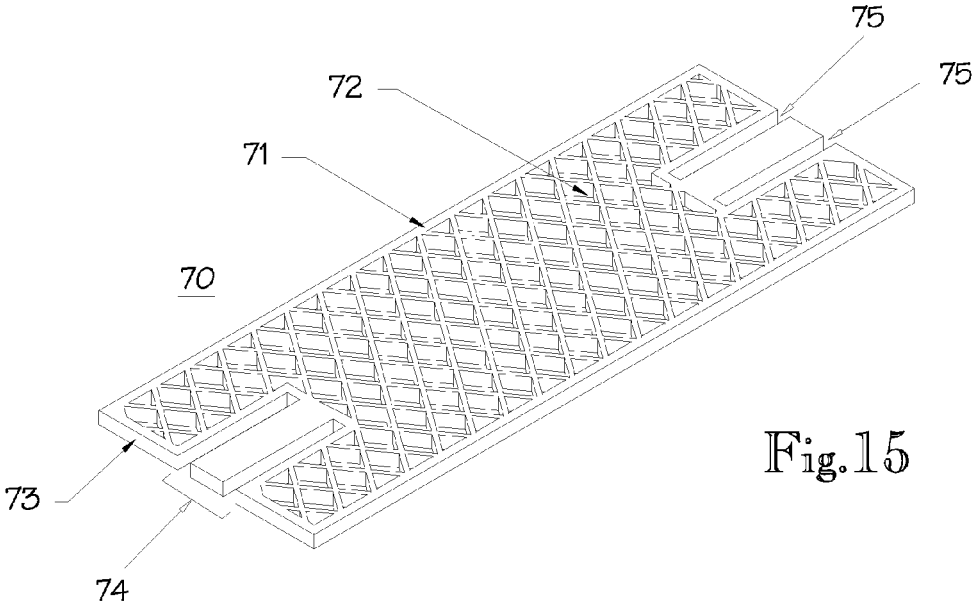
Figure 27:
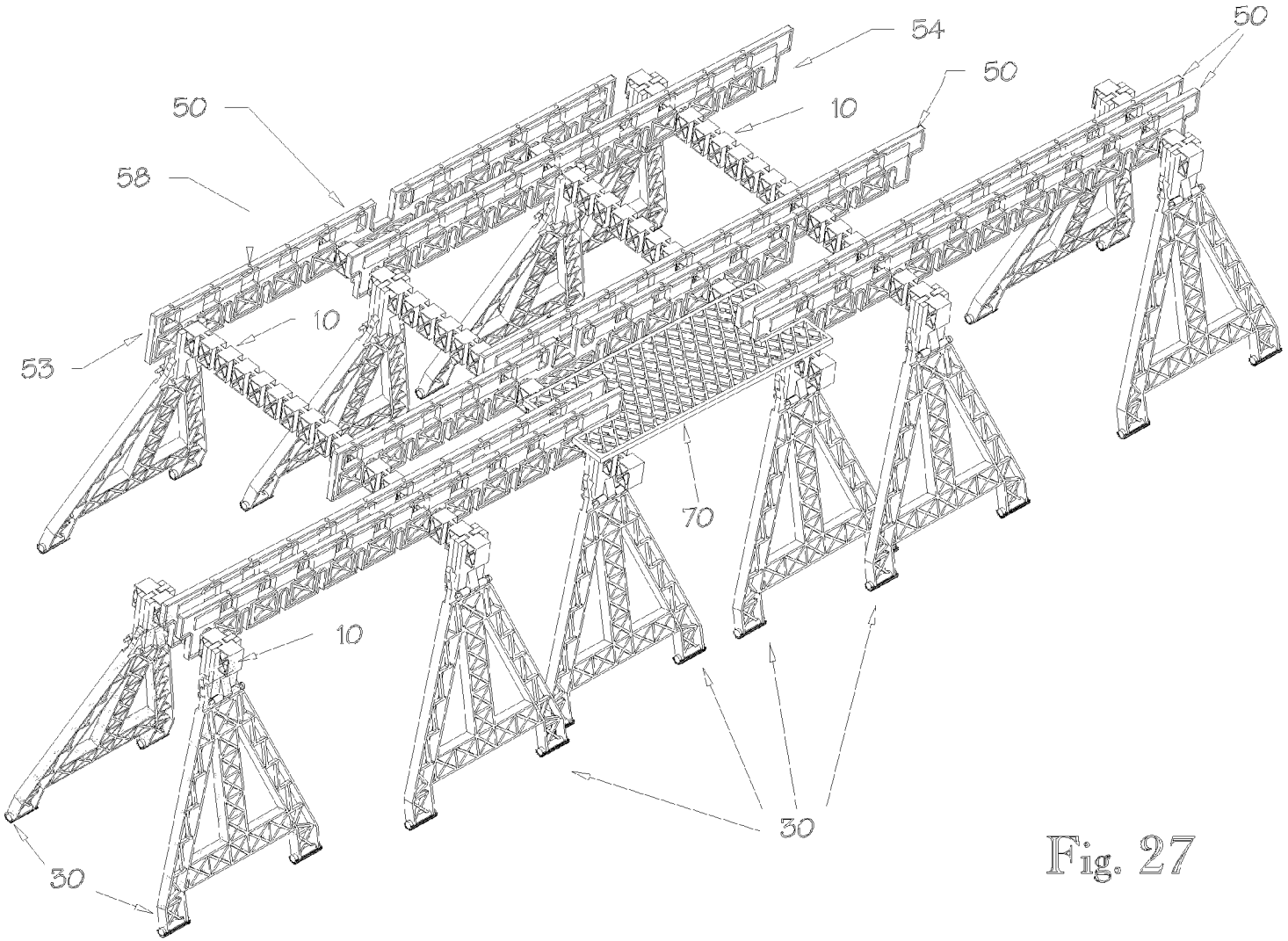
FIG. 27 is a perspective view of an assemblage useful as a work station that supports both a "feed-through" type tool (such as a portable table saw) and an "in-place" type tool (such as a powered miter saw).

FIG. 15 shows the tool mounting plate 70 in accordance with certain embodiments of the present invention. The top 71 of the mounting plate 70 is flat and may, in various embodiments, have an open web design 72. The ends 73 of the plate 70 have notch/ear connectors 74. The connectors are comprised of a pair of notches 75 whose width is dimensioned to permit the thickness of a rail 50 of that kit to pass through, but of a length which will only allow the lower portion of an ear end 54 of a rail 50 to pass through when the plate rests on a suitably placed set of cross beams 10 and is pinioned by such rails 50 when they are engaged with the notch/channel connectors 14 of two or more cross beams 10 (as shown in FIG. 27.)

Figure 16:
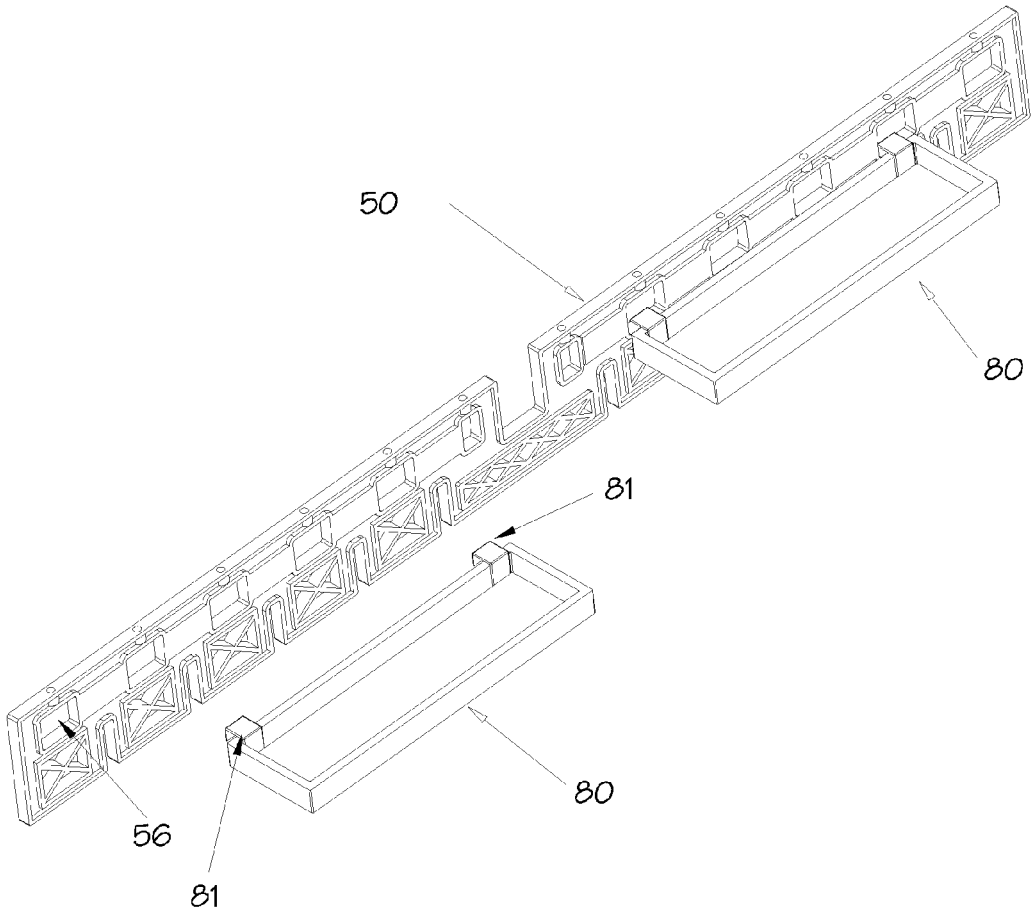

As shown in FIG. 16, in various embodiments the kit may include a tray or trays 80 for the convenient and accessible storage of small tools and parts. In various embodiments the trays 80 may be equipped with hooks, brackets or clips 81 which pass through one or more of the clamp apertures 56 of a rail 50 and engage with one lateral face of the rail 50 while cantilevering the tray against the other lateral face. In certain embodiments these trays may be adapted to holster hand-held power tools.

FIGS. 17 and 18 show a method of attaching the interconnecting parts together in accordance with certain embodiments of the present invention. As can be seen in FIG. 17, in certain embodiments, first a user aligns a cross beam connection location 14 with a leg connector 36. The connection location 14 of the cross beam 10 may be chosen by the user depending on the work station or work support that is to be assembled. Once a suitable connection location is chosen, the cross beam 10 is slid together with a leg 30 so that the connection location 14 is fully engaged with the leg connector 36. Once set, the top edge of the receiver section 32 and the top edge of the cross member 10 will be a substantially flat surface, as the various embodiments of the present invention may require. In certain embodiments of the present invention, two or more legs 30 will be joined to a cross beam 10 in this fashion.

Figure 20:
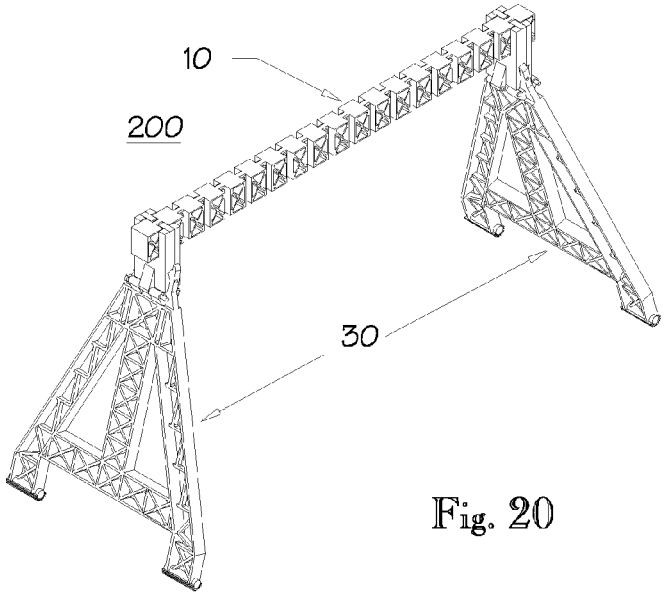
FIGS. 19-22 show examples of different configurations of the work station and work support structure sub-assemblies that may be assembled from a kit, according to various embodiments of the present invention.
Figure 22:
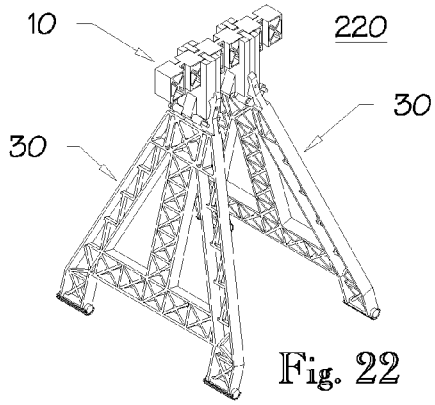
Figure 21:
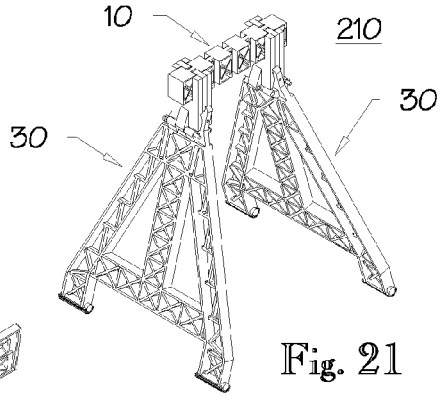

Once two or more cross beam and leg sub-assemblies 200, 210, 220 have been created (as shown in FIGS. 20, 21 & 22), a rail 50 may be positioned over the cross members of such sub-assemblies at any available location chosen by the user that may be aligned so that another notch 55 of that rail 50 may be engaged with any available connection location 14 of another cross beam and leg sub-assembly 200, 210, 220. To attach, the user applies a downward movement to the rail 50 so that the rail connector 55 mates with the connector(s) 14 of the cross beam(s) 10.

FIGS. 19-22 show examples of different configurations of the work station and work support structure sub-assemblies that may be assembled from this kit, according to various embodiments of the present invention.

Figure 19:
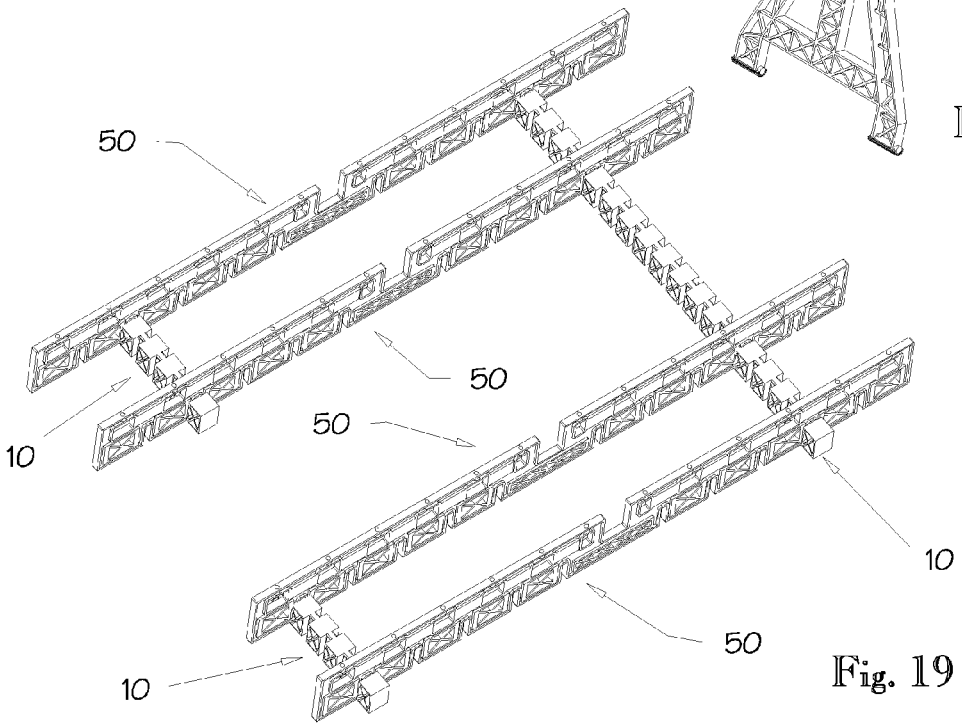

FIG. 19 shows a sub-assembly having three cross beams 10 and four rails 50. FIGS. 20, 21 & 22 show certain sub-assemblies using one cross beam 10 and two legs 30 (200, 210 & 220) where the legs 30 are engaged in different pairs of connector locations 14 on a cross beam 10. For various assemblages, the user may connect legs 30 to cross beams 10 and rails 50 to cross beams 10 at any appropriate and aligned connection location 14 that is not already occupied by another interconnected part.

Figure 23:
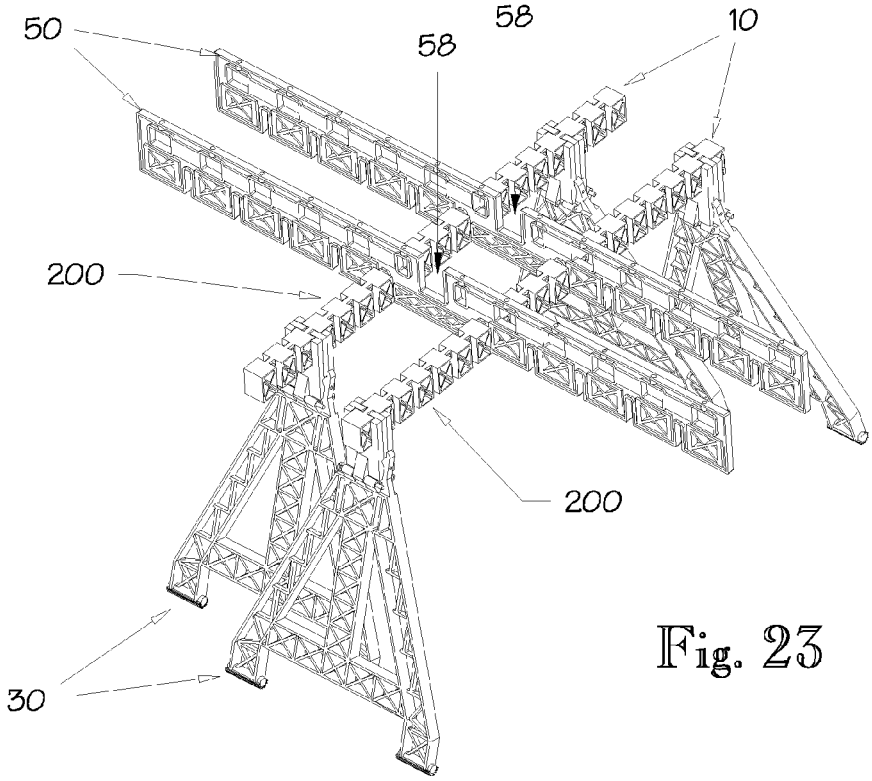
FIGS. 23 and 24 show how an assemblage may be reconfigured.
Figure 24:
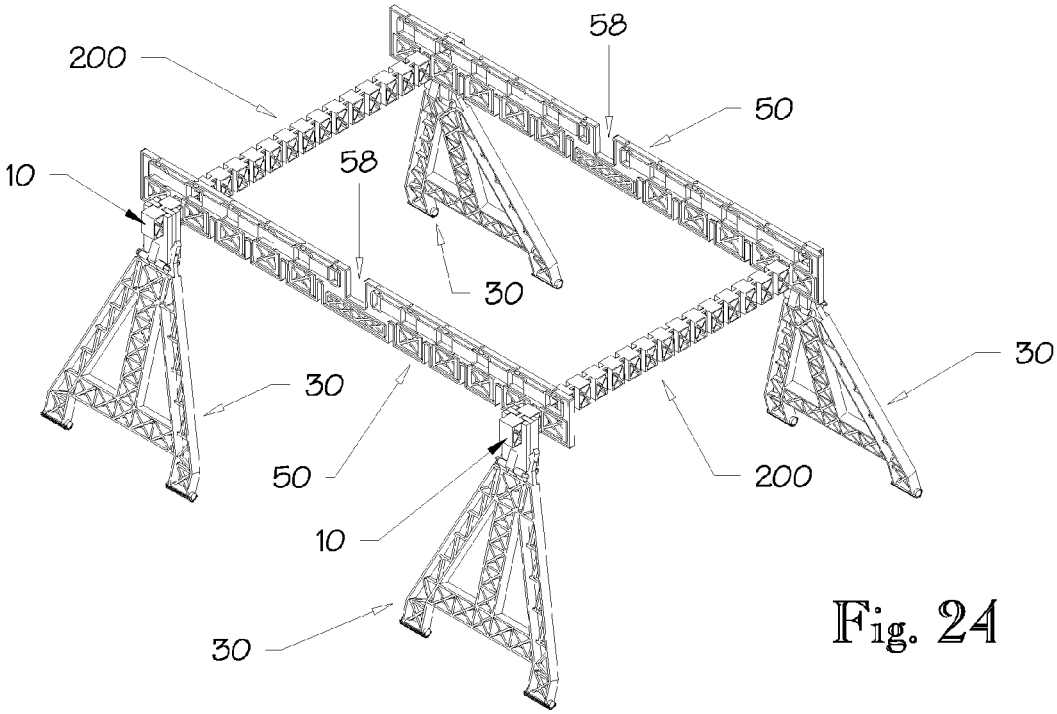

FIGS. 23 & 24 show how two similar workstations/work supports may be assembled from the same kit of parts according to the embodiments of the present invention, using four legs 30, two rails 50 and two cross beams 10 forming a "working surface" configuration with aligned cross-cut notches 58. To assemble, two sub-assemblies 200 as shown in FIG. 20 are set a finite distance apart from each other whose cross beam 10 channels 11 are aligned. Two rails 50 are then applied to both assemblages 200. The rails 50 both have center cross cut passthrough notches 58 and these notches 58 are aligned so that a saw blade may be run parallel to the cross beams 10 and perpendicular to the rails 50 without cutting into any part of the assemblage. Both of these particular assemblages suffer from the same deficit described in paragraphs [0008-0011] that afflicts all work supported on only two trestles.

FIG. 23 further illustrates how offsetting the legs 30 of adjacent leg/crossbeam subassemblies 200 relative to one another permits the cross beams 10 and their associated rails 50 to be brought into close proximity to one another without the legs 30 interfering with each other while still retaining the alignment of their cross-cut passthrough notches 58.

Figure 25:
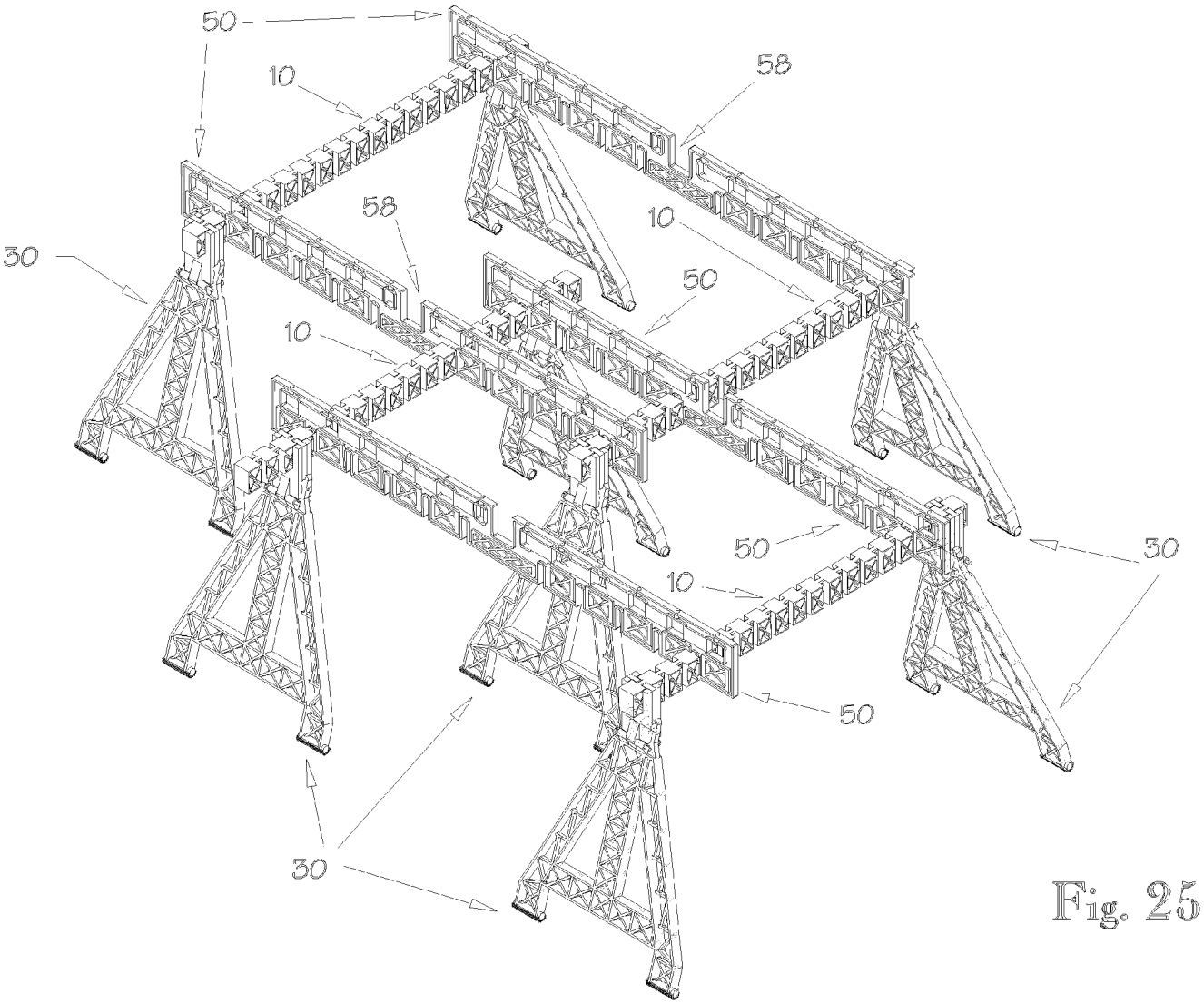
FIG. 25 is a perspective view illustrating how assemblages may be interconnected to extend a work station or a work support structure in either length or width. Any length or width is contemplated within the scope of the present invention.

FIG. 25 is a perspective view illustrating how different assemblages may be interconnected to extend the work station or work support in either the length or width. Any length or width is contemplated within the scope of the present invention.

Figure 26:
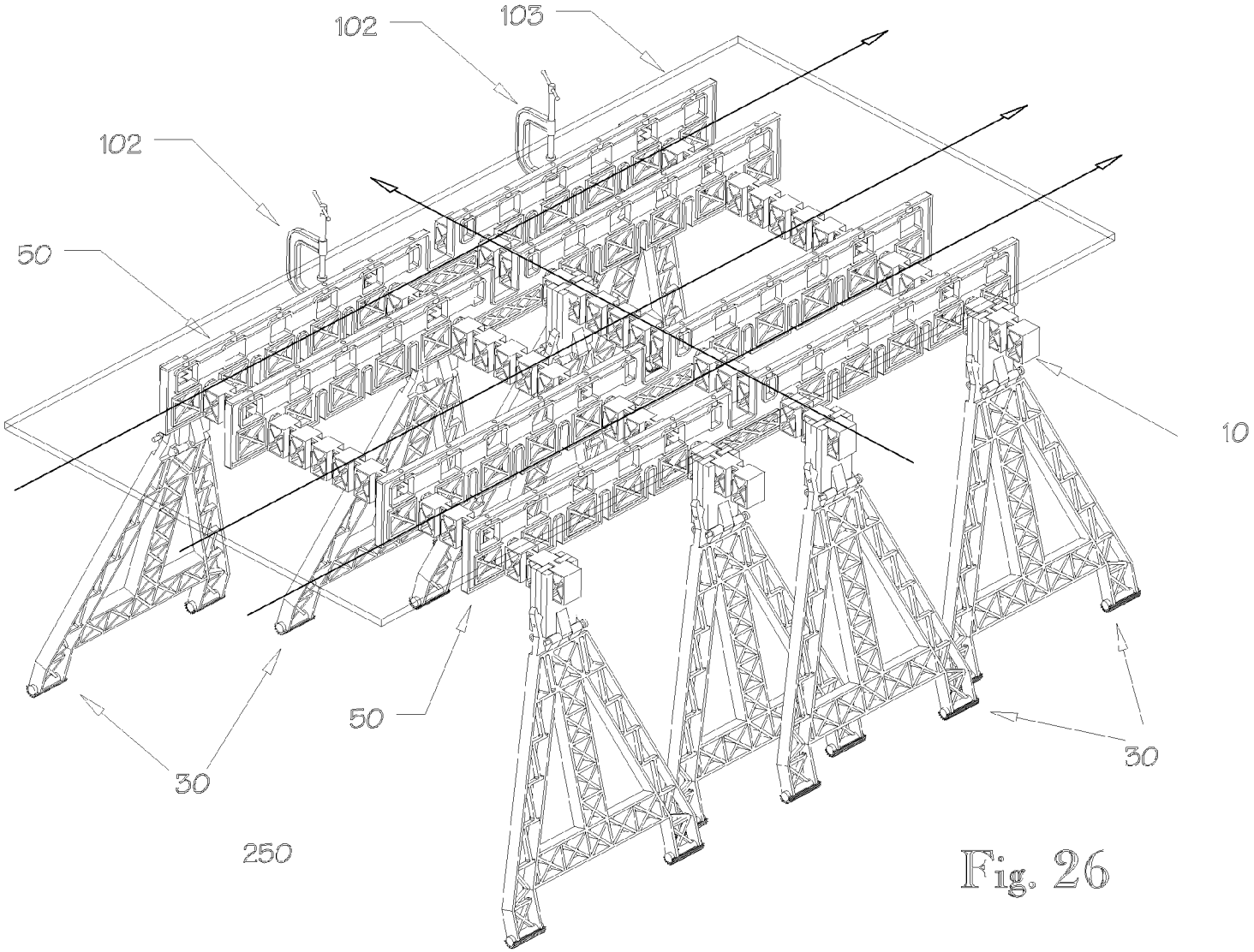
FIG. 26 is a perspective view of a workpiece mounted to a work support assembled utilizing various embodiments of the present invention.

FIG. 26 shows another possible assemblage of the present invention comprised of 8 legs 30, 4 cross beams 10 and 4 rails 50. The rails 50 may be deployed in any aligned group of connection locations of the cross beams 10, not already occupied by another connection to provide an unobstructed path for the portion of a cutting tool's edges that protrudes below the under surface of the workpiece and full support for both the keeper and the offcut for the full length of either a longitudinal or transverse cut or other operation, as shown by the arrows.

This configuration 250 provides a very stable work support structure with aligned cross-cut passthrough notches 58. Also shown in FIG. 26 is a workpiece that is set atop the assemblage. In this example, the workpiece 103 is fastened to the work support structure 250 via C-clamps 102. The jaws of the C-clamps 102 are positioned on the top face of the workpiece 103 and on the upper face of the clamp aperture 56. Any other clamp with suitable sized jaws may be substituted.

Figure 30:
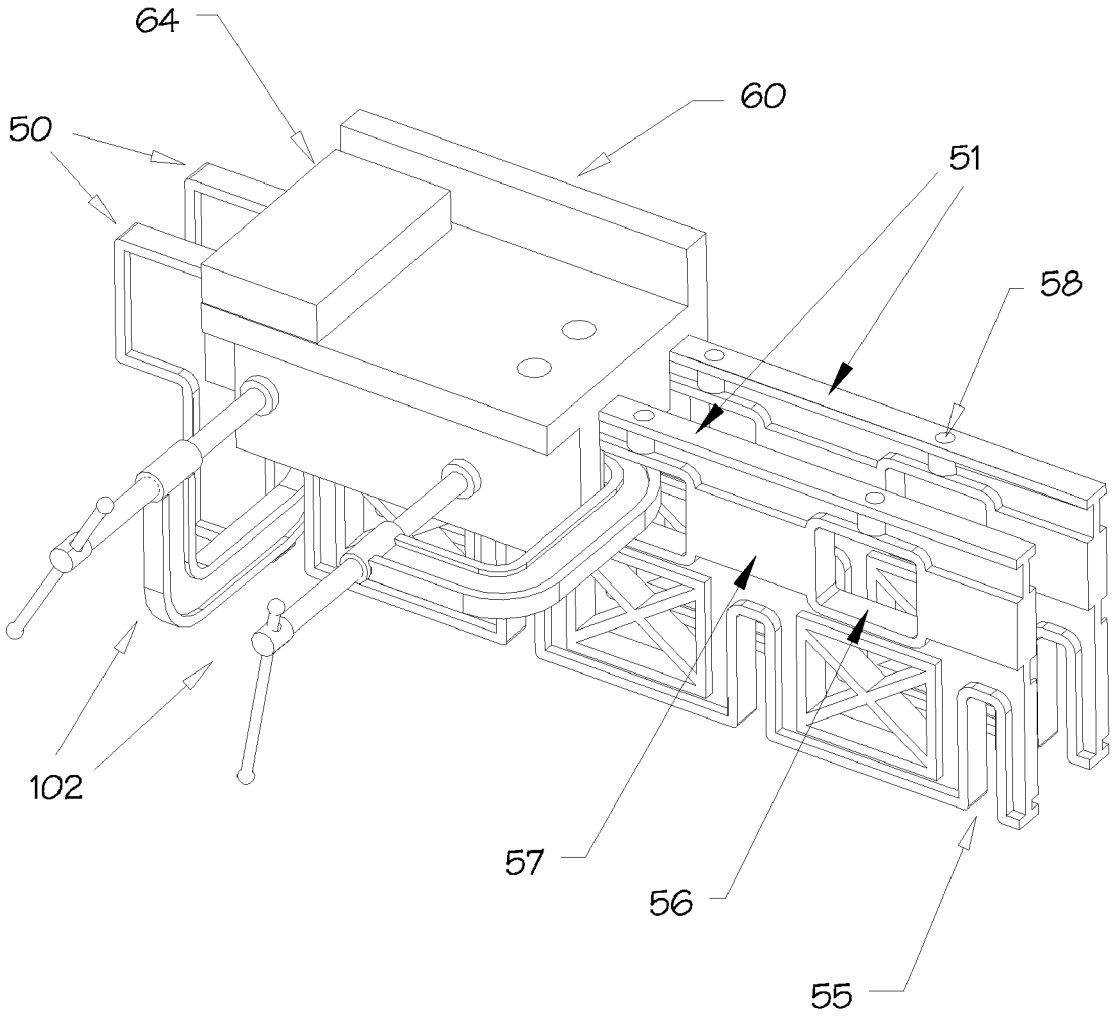
FIG. 30 is perspective view of a trolley mounted to a rail with a clamp according to various embodiments of the present invention.

FIG. 27 shows a possible assemblage, according to the embodiments of the present invention, comprised of 12 legs 30, 6 cross beams 10, eight rails 50 and a tool mounting plate 70; contemplated to be used as a work station in conjunction with a power miter saw 104, a portable table saw 105, an unfinished hollow core door 106 and two trolleys 60. In order for the trolleys 60 and the mounting plate 70 to be mounted, two pairs of rails 50 with at least one ear end 54 each must be set next to each other and engage the ear/notch connector 74 of the mounting plate 70 placed on two suitably spaced cross beams 10. Once set, the trolley 60 can be interconnected with the top edge of the rails 50. The trolley 60 then may be slid along the upper aspect 51 of rail 50 to any position along a pair of rails 50 and be temporarily secured in that position by clamps which pinion the trolley 60 against the clamp pads 57 (as shown in FIG. 30.) Using the snap-in stop 64 (as shown in FIGS. 13 and 14) in conjunction with this capability creates the capacity of using the power miter saw to rapidly cut identical lengths.

Figure 28:
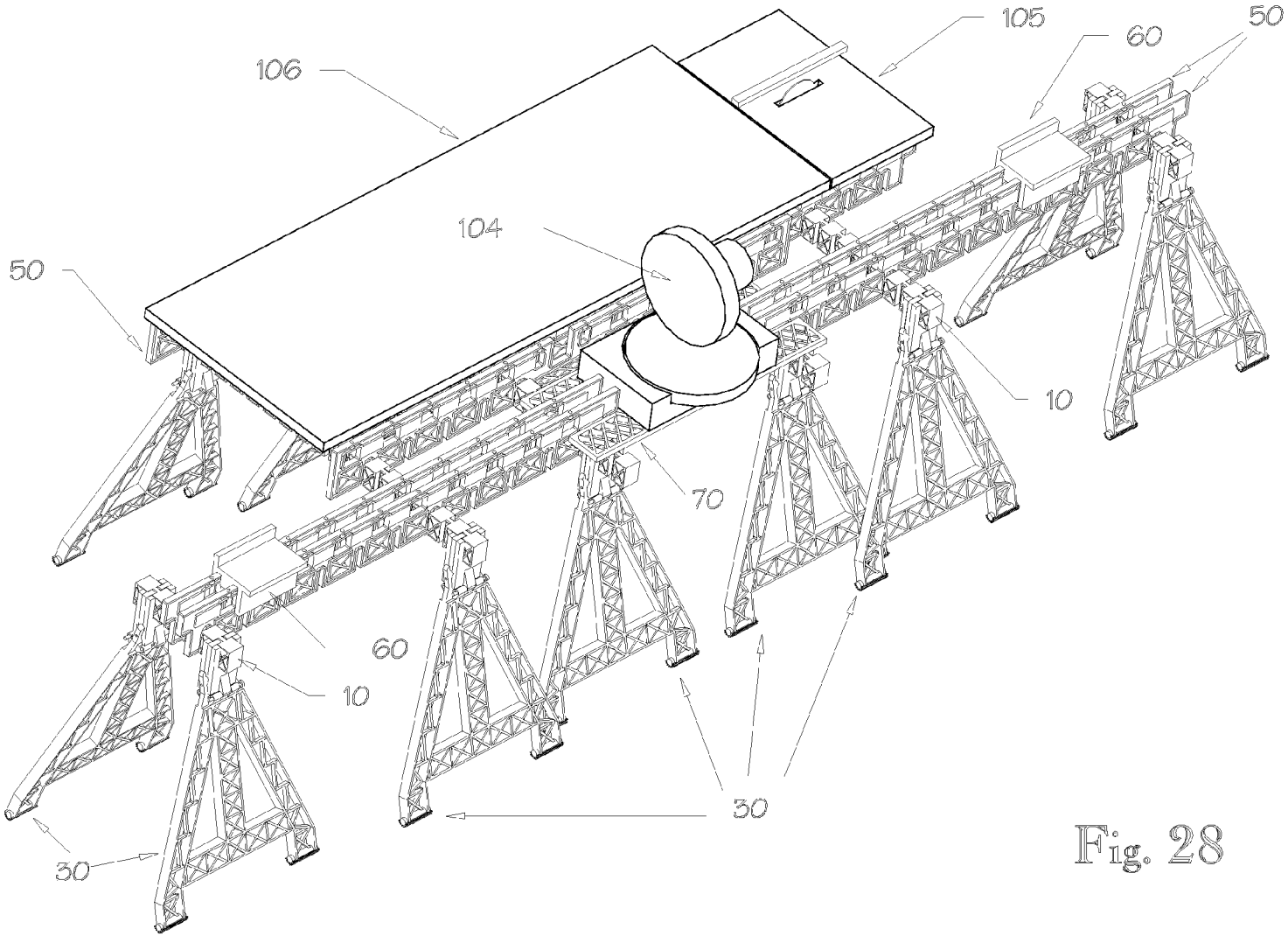
FIG. 28 is a view of this assemblage, with its tools and accessories mounted thereon.

FIG. 28 shows this same assemblage with its tools and accessories mounted. In this configuration both tools may be used without the necessity of removing either. By dismounting the power miter saw 104, the capacity of the table saw 105 to make cross-cuts in wide or otherwise ungainly materials is greatly enhanced by the side-feed capacity previously used by the power miter saw 104.

Assemblages that exhibit some or all of the characteristics of both a work support and/or a work station may be created utilizing the embodiments of the present invention.

Figure 29:
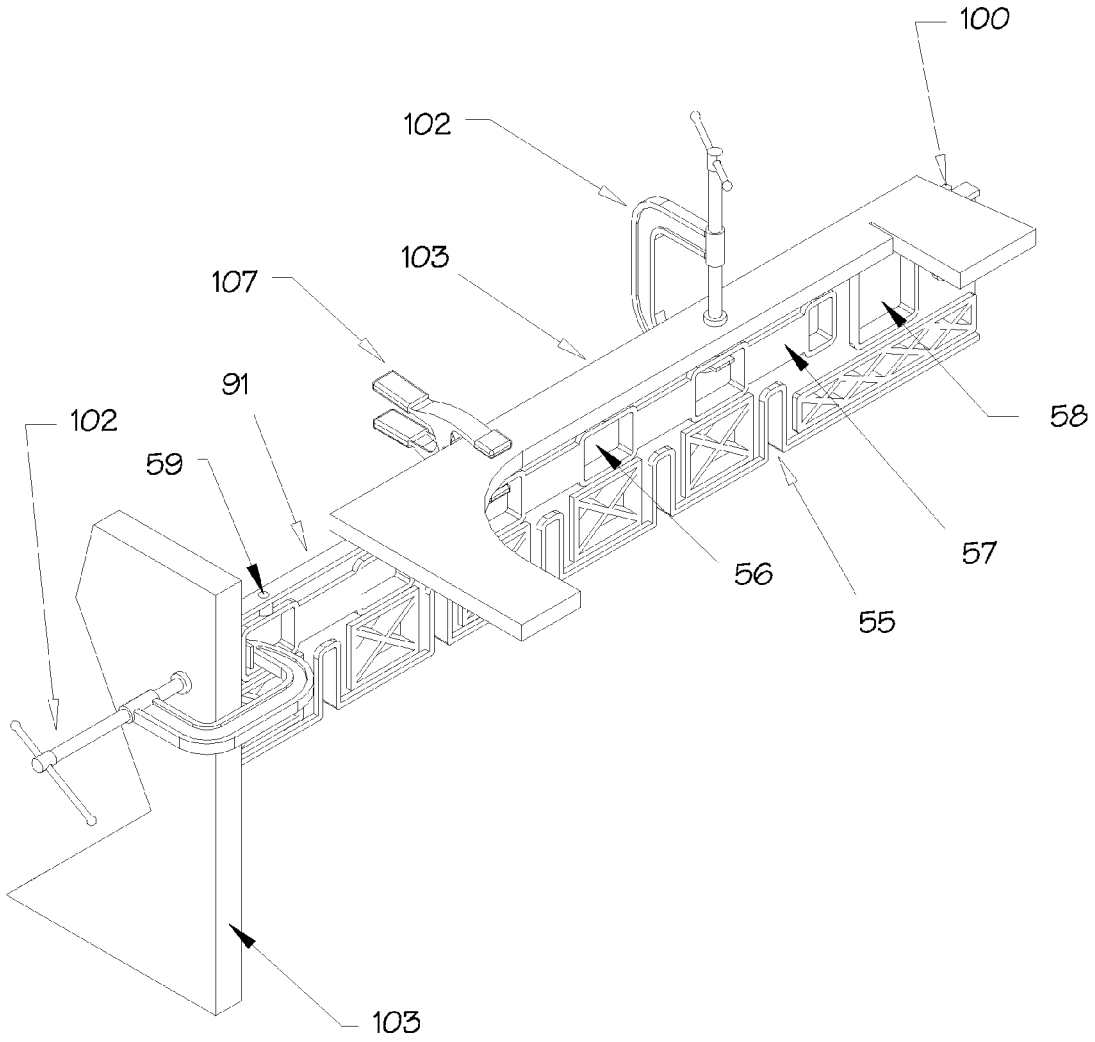
FIG. 29 is a perspective view of a section of a rail illustrating some of the methods by which a workpiece may be secured to a rail, and the functioning of the cross-cut pass-through notch.

FIG. 29 illustrates how workpieces 103 may be mounted to the top aspect 51 and the end aspect 53 of a rail 50 using either spring clamps 107, C-clamps 102, a stop pin 100 or any combination thereof. The clamps 102 and 107 are in contact with the upper or outer faces of the workpieces 103 and the top or side aspects of the clamp apertures 56.

FIG. 30 illustrates how a C-clamp 102 may be used to immobilize a trolley 60 on a pair of rails 50. In this illustration, the C-clamp 102 is in contact with one of the downward facing flanges 67 of the trolley 60 and a clamp pad 57. The clamp may be used in either position shown, whichever is more suitable.

FIG. 31 shows a user supplied jig for cutting disks and rings 108 fastened to two rails 50 by the use of threaded bolts 101 in the pin sockets 58. The bolts 101 rest in counter bored holes in the jig, pass through the pin sockets 58 and may be fastened with a nut and washer where the bolt emerges in the clamp aperture 56

The interconnecting parts of an assemblage of the present invention may be standardized such that multiple assemblages can be used in conjunction with each other.

The structures of the disclosed technology may be used with other types of portable "bench type" power tools whose performance would benefit from the additional infeed, outfeed and side feed support such a structure may provide.

The interconnecting parts may be made from a variety of materials such as wood, metal or any polymeric material, e.g., plastic resin or fiberglass reinforced plastic. The parts may be hollow and/or be filled with additional material. For example, the parts may be filled with polyurethane foam to make them rigid and light or heavy materials to increase their mass. They can be cast, injection molded, rotationally molded, milled or laid-up over a core.

The present invention disclosure is to be understood as being in every respect illustrative and exemplary, but not restrictive, and the embodiments shown and described herein are only illustrative of the principles of the present invention. Modifications may be implemented by those skilled in the art without departing from the scope and spirit of the invention.

What is claimed is:

1. A kit comprised of any or all of the following parts, said kit comprising:

One or more cross beams, that each include an elongated plurality of segments extending a latitudinal direction with opposing parallel channels extending in a longitudinal direction inbetween said segments;

One or more stands, that each include a triangular cross section with a base and a connector located at an apex of said triangular cross section wherein said connector comprises a longitudinal center groove with two side members;

One or more rails, that each include a plurality of notches extending along a latitudinal direction wherein said notches are recessed into said rail;

One or more tool mounting plates that each include a plurality of notches at at least one end of said plate;

One or more trolleys that each include at least a plate with a channel connector with parallel flanges;

wherein said parts can be formed into one or more work support structures or workstations.

2. The kit of claim 1, wherein at least one of said rails include an additional element chosen from: cross-cut passthrough notches, clamp openings, clamp pads, pass ear end comprising a protrusion on at least one end of an upper portion of said rail, pin sockets or combinations thereof.

3. The kit of claim 2, wherein the triangular base includes legs.

4. The kit of claim 3 wherein said one or more mounting plates includes a plurality of notches on a second end.

5. The kit of claim 4 wherein the connector of said stand is hinged.

6. The kit of claim 5 wherein the stand and receiver sections may be fixed at either extreme of their relative travel with a latch or fastening.

7. The kit of claim 6 wherein said kit further includes trays.

8. The kit of claim 7 wherein the trolley further includes an addition plate comprising a snap-in stop on a bottom of said additional plate wherein said trolley plates has apertures for receiving said snap in stop.

9. The kit of claim 7 wherein the trolley plate further includes an upward facing flange and inbetween said flanges on a bottom of said trolley plate is a spacer block which creates two parallel spaces.

10. The kit of claim 6 wherein said kit further includes trays comprising a plurality of hooks.

11. The kit of claim 1 wherein said kit further includes a jig comprising a plate with apertures for fasteners, an off set aperture and elongated slot in which rides a pivot that may be fixed at any point of travel.

12. The kit of claim 1 wherein said kit further includes a plate with apertures for fasteners.

13. A kit comprised of any or all of the following parts said kit comprising: cross beams, that each include an elongated plurality of segments extending a latitudinal direction with opposing parallel channels extending in a longitudinal direction in between said segments; a plurality of stands, that each include a triangular cross section with a base and a connector located at an apex of said triangular cross section wherein said connector comprises a longitudinal center groove with two side members;

a plurality of rails, that each include a plurality of notches extending along a latitudinal direction wherein said notches are recessed into said rail;

a plurality of tool mounting plates that each include a plurality of notches at least one end of said plate;

a plurality of trolleys that each include at least a plate with a channel connector with parallel flanges;

wherein said parts can be formed into one or more work support structures or workstations.

* * * * *